United States Patent [19]

Frigon et al.

[11] Patent Number: 5,022,176

[45] Date of Patent: Jun. 11, 1991

[54] GUN BARREL RAMROD HOLDER

[76] Inventors: Phillip E. Frigon, R.R. 1, Box 109A; Robert D. Rott, 1516 First St., both of Clay Center, Kans. 67432

[21] Appl. No.: 461,982

[22] Filed: Jan. 8, 1990

[51] Int. Cl.[5] ..... F41C 27/00

[52] U.S. Cl. ..... 42/90; 42/95

[58] Field of Search ..... 42/90, 95

[56] References Cited

U.S. PATENT DOCUMENTS 4,327,515 5/1982 Kuryn ..... 42/90

4,407,086 10/1983 Hasselmann ..... 42/90

4,875,303 10/1989 DeWeert et al. ..... 42/90

*Primary Examiner*—Charles T. Jordan

[57] ABSTRACT

A holding device for storing a ramrod on the barrel of a shotgun or other firearm. Two sight elements which form the sight of the firearm are mounted on blocks which are secured to the top of the barrel. Each block is provided with a longitudinal passage through which the ramrod can be extended when it is to be stored. One block has a set screw threaded into its side for releasably locking the ramrod in place in its storage position.

11 Claims, 1 Drawing Sheet

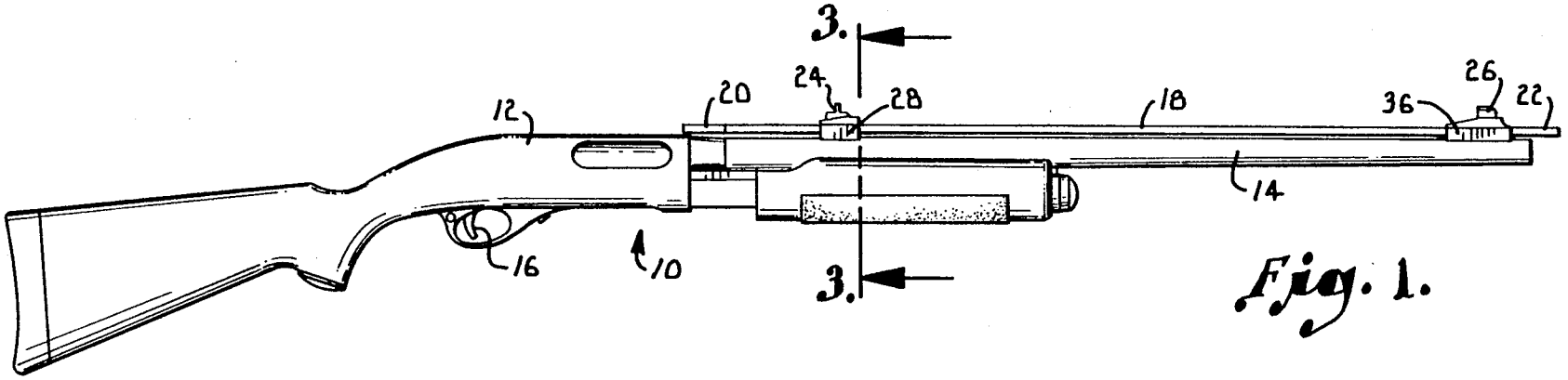
Fig. 1.
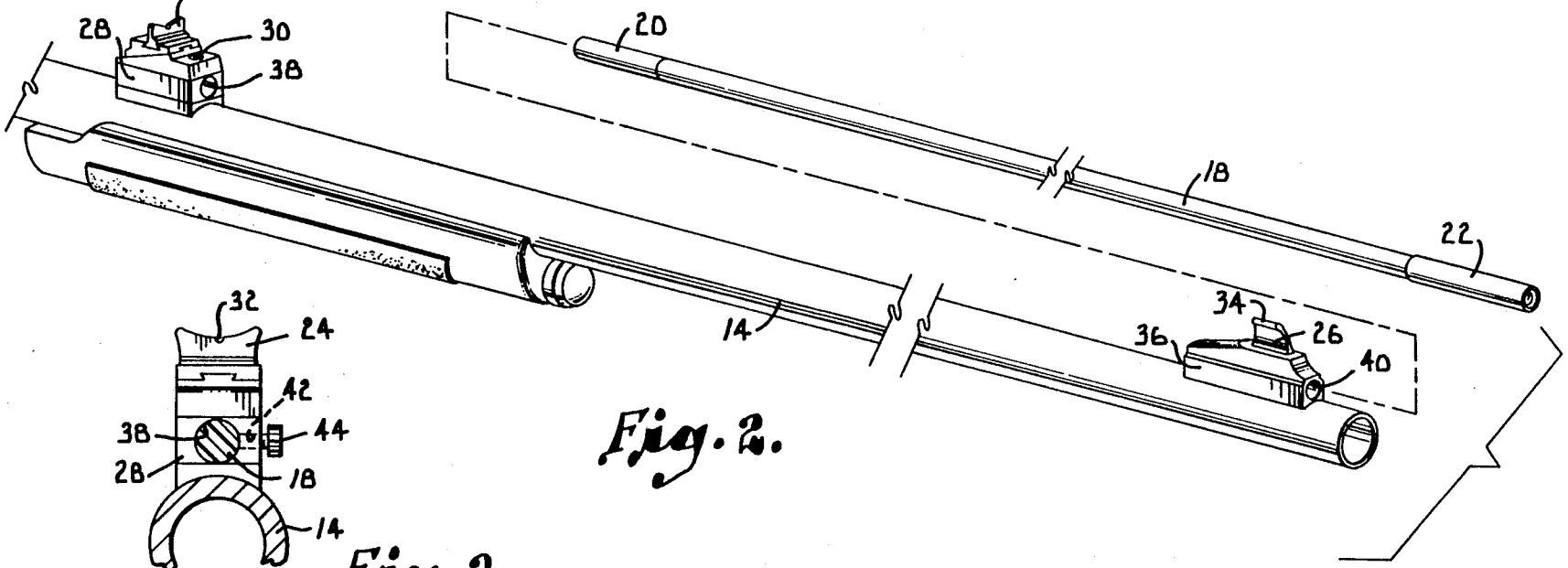
Fig. 2.
Fig. 3.

GUN BARREL RAMROD HOLDER

BACKGROUND AND SUMMARY OF THE INVENTION

This invention relates generally to firearms and more particularly to an arrangement for storing a ramrod on a gun barrel.

The barrels of shotguns and other firearms must be periodically cleaned, usually by using a ramrod which is provided with a cleaning attachment. The ramrod is extended into the barrel so that the cleaning attachment can remove foreign material from the inside of the barrel. Typically, the ramrod is stored apart from the firearm and must be located when it is needed for use. This makes it inconvenient to clean the barrel which in turn results in barrels being cleaned less frequently than is desirable.

Accordingly, the principal object of the present invention is to provide a ramrod holder which stores the ramrod on the barrel of a firearm where the ramrod is conveniently accessible when it is needed for use in cleaning the barrel.

Another object of the invention is to provide a ramrod holder which is arranged to store the ramrod at a location where it does not obstruct the firearm sight system or otherwise interfere with use of the firearm.

An additional object of the invention is to provide a ramrod holder that is constructed to lock the ramrod securely in place in its stored position and yet permit the ramrod to be easily released when needed for use.

A further object of the invention is to provide a ramrod holder of the character described which is constructed in a simple and economical manner and which is suitable for installation on firearms that vary in type, size and style.

Other and further objects of the invention, together with the features of novelty appurtenant thereto, will appear in the course of the following description.

DESCRIPTION OF THE DRAWINGS

In the accompanying drawings which form a part of the specification and are to be read in conjunction therewith and in which like reference numerals are used to indicate like parts in the various views:

FIG. 1 is a side elevational view of a firearm which is equipped with a ramrod holder on its barrel in accordance with a preferred embodiment of the present invention, with the ramrod in its storage position on the barrel;

FIG. 2 is a fragmentary perspective view on an enlarged scale depicting the manner in which the ramrod is applied to and removed from the ramrod holder on the firearm barrel, with the break lines indicating continuous length of the ramrod and barrel; and FIG. 3 is a fragmentary sectional view on an enlarged scale taken generally along line 3—3 of FIG. 1 in the direction of the arrows and showing the set screw of the ramrod holder threaded against the ramrod to lock it in place in its stored position.

DETAILED DESCRIPTION OF THE INVENTION

Referring now to the drawings in more detail and initially to FIG. 1, numeral 10 generally designates a firearm which may take the form of a shotgun or another type of firearm having a stock 12, and elongated barrel 14 extending from the stock and a trigger 16. A ramrod 18 is used to clean the barrel 14 and is provided on its opposite ends with internally threaded fittings 20 and 22. A suitable cleaning attachment (not shown) may be attached to one of the end fittings 20 and 22, and the ramrod 18 may then be extended into the barrel 14 such that the cleaning attachment removes foreign material from the inside of the barrel. The ramrod 18 may be constructed of any suitable material and should be long enough to extend the entire length of the barrel 14. The end fittings 20 and 22 are cylindrical with fitting 22 being slightly larger in diameter than fitting 20 or the ramrod 18.

In accordance with the present invention, the ramrod 18 may be stored on top of the barrel 14 at a location below a pair of sight elements 24 and 26 which cooperate to form a sight system for the firearm that is used in guiding aim of the firearm.

With additional reference now to FIGS. 2 and 3, sight element 24 is secured on top of a mounting block 28 by screws 30 (see FIG. 2) or other suitable fastening means. The mounting block 28 is in turn secured on top of the barrel 14 near the stock end. The sight element 24 is constructed conventionally and has a small sight opening 32 through which a bead 34 on the other sight element 26 is sighted. The sight element 24 may be adjusted up and down, back and forth and side to side in a conventional manner.

Sight element 26 is secured to another mounting block 36 by any suitable means. Block 36 is mounted on top of the barrel 14 near its discharge end well away from block 28.

In accordance with the present invention, block 28 is provided with a cylindrical passage 38 which extends completely through the block in a direction parallel to the length of the barrel 14. The other mounting block 36 is provided with a similar cylindrical passage 40 which extends completely through block 36 and is axially aligned with passage 38. The passages 38 and 40 are slightly larger in diameter than the ramrod 18 and fitting 20 but are somewhat smaller in diameter than the end fitting 22.

Referring now to FIG. 3, an internally threaded passage 42 is formed in one side of mounting block 28 and intersects with passage 38. A set screw 44 is threaded into passage 42 and may be tightened against the ramrod 18 in order to securely lock it in place.

The ramrod 18 is normally stored on top of the barrel 14 and below the sight elements 24 and 26. To place the ramrod 18 in the stored position, fitting 20 is first extended through the passage 40 in block 36 and then through the passage 38 in block 28 until the fitting 22 butts against the outer end of block 36. Because fitting 22 is larger in diameter than passage 40, it is unable to enter the passage. The set screw 44 can then be tightened against the ramrod 18 and, when fully tightened, the set screw 44 acts to securely lock the ramrod in place in the holding device to make certain that the ramrod does not inadvertently slide back and forth when the firearm is being used or carried.

The firearm 10 can be used in the normal manner with the ramrod in its stored position on top of the barrel 14. It is noted that the ramrod 18 is located below the sight elements 24 and 26, so it does not obstruct sighting of the bead 34 through the sight opening 32. Additionally, the ramrod 18 is located on top of the barrel 14 where it does not interfere with any of the operating mechanisms of the firearm. Thus, the ramrod 18 is held securely in place on the barrel 14 at an out of the way location where it does not interfere with normal use of the firearm and yet is conveniently accessible when needed for use.

In order to remove the ramrod 18 from its storage position for use, the set screw 44 is first loosened to release the ramrod. The ramrod can then be pulled outwardly to pull the end fitting 20 through passage 38 and then through passage 40, after which the ramrod is free of the holding device and may be used to clean the barrel 14 in the usual manner. After the ramrod has been used, it can be returned to the storage position in the manner indicated previously, and it is thereafter securely held in the storage position after the set screw 44 has been tightened again.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, we claim:

1. Apparatus for temporarily storing a ramrod on a firearm having a barrel, said apparatus comprising:
   - a pair of sight elements cooperating to provide a sight for guiding the aim of the firearm;
   - means for mounting said sight elements on the barrel at spaced apart locations thereon, said mounting means including spaced apart mounting elements on the barrel; and
   - means on each of said mounting elements for receiving and holding the ramrod in a manner allowing selective removal of the ramrod.

2. Apparatus as set forth in claim 1, including releaseable means for locking the ramrod to one of said mounting elements.

3. Apparatus as set forth in claim 2, wherein said releaseable means comprises a set screw having a threaded connection with said one mounting element.

4. Apparatus as set forth in claim 1, wherein:
   - said mounting means comprises a pair of mounting blocks on the barrel on which the respective sight elements are mounted; and
   - said receiving and holding means comprises a passage in each block through which the ramrod is extendable for storage of the ramrod when not in use.

5. Apparatus as set forth in claim 4, including releaseable means for locking the ramrod to one of said mounting blocks.

6. Apparatus as set forth in claim 5, wherein said releaseable means comprises a set screw having a threaded connection with said one mounting block.

7. In combination with a firearm having a barrel, ramrod holding apparatus comprising:
   - a pair of mounting blocks on the barrel spaced apart from one another thereon;
   - a pair of sight elements mounted on the respective mounting blocks and cooperating to provide a sight for guiding aim of the firearm; and
   - a passage in each mounting block large enough to receive a ramrod, whereby the ramrod can be held on the barrel in said passages when not in use without obstructing use of said sight elements.

8. The invention of claim 7, including releaseable means for locking the ramrod to one of said mounting blocks.

9. The invention of claim 8, wherein said releaseable means comprises a set screw having a threaded connection with said one mounting block.

10. In a firearm having an elongate barrel, a ramrod holding arrangement comprising:
   - a pair of mounting blocks spaced apart from one another on the barrel, each block having a passage therein large enough to receive a ramrod to permit the ramrod to be held in the passage when not in use;
   - a pair of sight elements mounted on the respective mounting blocks at locations to cooperate to provide a sight for guiding aim of the firearm; and
   - releaseable means for locking the ram rod in the passages.

11. The invention of claim 10, wherein said releaseable means comprises a set screw having a threaded connection with one of said mounting blocks.

* * * * *